US005839435A

United States Patent [19]

Matsuoka et al.

[11] Patent Number: 5,839,435

[45] Date of Patent: Nov. 24, 1998

[54] MOUTHPIECE UNIT FOR SEMICLOSED-CIRCUIT BREATHING APPARATUS

[75] Inventors: Shunsuke Matsuoka; Kiyoshi Hashimoto, both of Chiba-ken, Japan

[73] Assignee: Grand Bleu, Inc., Tokyo, Japan

[21] Appl. No.: 860,841

[22] PCT Filed: Oct. 25, 1995

[86] PCT No.: PCT/JP95/02196

§ 371 Date: Oct. 7, 1997

§ 102(e) Date: Oct. 7, 1997

[87] PCT Pub. No.: WO97/15487

PCT Pub. Date: May 1, 1997

[51] Int. Cl.[6] ..... A62B 7/10

[52] U.S. Cl. ..... 128/205.12; 128/205.17; 128/205.24; 128/204.26

[58] Field of Search ..... 128/201.27, 205.12, 128/205.17, 205.24, 204.26, 205.13, 205.22

[56] References Cited

U.S. PATENT DOCUMENTS 4,273,120 6/1981 Oswell ..... 128/204.26
4,781,184 11/1988 Fife ..... 128/205.12
4,938,211 7/1990 Takahashi et al. ..... 128/204.26

*Primary Examiner*—John G. Weiss
*Assistant Examiner*—Charles W. Anderson
*Attorney, Agent, or Firm*—Darby & Darby

[57] ABSTRACT

A mouthpiece unit (6) of a semiclosed-circuit breathing apparatus (1) includes a inhaled/exhaled air circulation chamber (61), an inhalation gas supply opening (71) for providing a constant flow of fresh breathing gas from a breathing gas cylinder, a mouthpiece (62) attached to an external opening (65), and manually operated members (75, 76) that are maintained at an initial position by a resilient force and can be moved to a first operating position against the resilient force. In an interlocking operation, movement of the manually operated members to the first operating position is accompanied by opening of an external opening (65) by a valve (101). A first lever (73) opens and closes the gas supply opening (71) in conjunction with the opening and closing operation of the valve (101). A latch lever (105) is engaged with the valve (101) when the valve (101) is in the open state, and maintains this engagement to thereby maintain the valve (101) in an open state as long as the diver holds the latch lever (105) in his or her mouth. If the latch lever (105) comes out of the mouth, the external opening valve (101) and gas supply opening (71) close automatically.

2 Claims, 7 Drawing Sheets

MOUTHPIECE UNIT FOR SEMICLOSED-CIRCUIT BREATHING APPARATUS

TECHNICAL FIELD

This invention relates to a mouthpiece unit adapted for use with a semi closed-circuit breathing apparatus constituted so that exhaled air recovered from a mouthpiece is regenerated by being passed through a carbon dioxide adsorption apparatus, and a mixture of the regenerated gas and a constant flow of fresh gas for inhalation supplied from a breathing gas cylinder is supplied to the mouthpiece as inhalation gas and surplus gas is discharged to the outside.

BACKGROUND ART

Underwater breathing apparatuses can be broadly divided into two types, one type being an open-circuit breathing apparatus and the other type a closed-circuit or semiclosed-circuit breathing apparatus. In an open-circuit breathing apparatus, gas that has been breathed once is expelled from the apparatus, but a closed-circuit or semiclosed-circuit breathing apparatus includes an apparatus that enables gas that has been breathed to be used again.

A closed-circuit or semiclosed-circuit breathing apparatus generally has the advantage of being lighter than an open-circuit breathing apparatus and permitting longer dives to deeper depths. However, since conventional closed-circuit or semiclosed-circuit breathing apparatuses were developed for specialized diving applications or military use, they were equipped with only a minimum of safety mechanisms, and had no mechanisms for coping with emergency situations that occur relatively easily. For this reason, rigorous training was required to use this type of apparatus, and thus it could not be readily used by recreational divers.

However, the growing popularity of diving generated increasing demand for closed-circuit or semiclosed-circuit breathing apparatuses that were not overly complicated to operate and did not require such rigorous training. Equipped as it is with oxygen concentration sensors and the like, a closed-circuit breathing apparatus requires considerable training with respect to handling, control and monitoring. In contrast, a semiclosed-circuit breathing apparatus has no such equipment and therefore can be operated without training, so it can be handled relatively easily even by a non-expert.

Semiclosed-circuit breathing apparatuses that are simpler and easier to use than before would be highly convenient. There are various improvements that can be implemented to make such semiclosed-circuit breathing apparatuses more readily accessible than before. For example, since the pressure in the mouthpiece and in inhalation and exhalation passages in communication with the mouthpiece is about the same as the surrounding pressure, outside water can enter the apparatus via the mouthpiece. If a person using the apparatus is a novice, there is quite a high possibility that while submerged the mouthpiece may become dislodged from the person's mouth, allowing water to enter the apparatus through the mouthpiece. This water can have an adverse effect, such as on the carbon dioxide gas adsorption apparatus. Thus, a mechanism that does not allow the intrusion of water into the apparatus is desirable, and there is a need for a mechanism that will automatically expel any water that does enter.

In the case of an inhalation passage, this type of problem can be resolved by the provision of a check valve at the connection between the inhalation air hose and mouthpiece that only permits a fluid to pass from the inhalation air hose to the mouthpiece. However, a check valve does not solve the problem in the case of an exhalation passage, since exhaled air has to be passed from the mouthpiece to the exhalation air hose, so a different contrivance is required.

In contrast, because an open-circuit breathing apparatus does not have an exhalation air hose and the pressure inside the inhalation air hose is higher than the surrounding pressure, the entry of outside water into the apparatus via the mouthpiece does not occur.

Concerning this point, in International Patent Application No. W/O 95/09762 the present inventors proposed a mouthpiece unit that is easy to use, even by a novice. This mouthpiece unit has a manually operated member, operation of which caused chewing pieces to project out from the mouthpiece, and the diver continues to be supplied with fresh breathing gas as long as the chewing pieces are held in the mouth. If the diver should accidentally let the mouthpiece come out of his or her mouth, the chewing pieces retract into the mouthpiece unit, closing off the exhalation air hose. Thus, the result is that the entry of water is prevented automatically. In addition to the manually operated member, a purge lever is provided that when operated causes fresh breathing gas to be delivered at a high flow rate to purge the mouthpiece unit of water. Thus, a diver can expel any water in the mouthpiece unit simply by operating this purge lever.

DISCLOSURE OF THE INVENTION

An object of the present invention is to provide a mouthpiece unit that is easy to use even by a novice.

Namely, an object of the present invention is to provide a mouthpiece unit that automatically shuts off the supply of breathing gas if the mouthpiece comes out of a diver's mouth and automatically prevents entry of water into the apparatus.

An object of the present invention is also to provide a mouthpiece unit that is able readily to purge an interior of a mouthpiece of water.

A further object of the invention is to provide a mouthpiece unit that, when a user requires a large amount of breathing air, is able to supply a large amount of breathing air with a simple operation.

To attain the above object, the present invention provides a mouthpiece unit for a semiclosed-circuit breathing apparatus, comprising:

an inhaled/exhaled air circulation chamber that includes an opening in communication with an exhalation air hose for circulation of exhaled air, an opening in communication with an inhalation air hose for circulation of inhaled air, and an external opening in communication with an exterior;

a gas supply opening for supplying the inhaled/exhaled air circulation chamber with a constant flow of fresh breathing gas from a breathing gas cylinder;

a mouthpiece attached to the external opening;

a manually operated member that is maintained at an initial position by resilient force and can be shifted to a first operating position against the resilient force;

an external opening valve for opening the external opening in interlocked operation with the shift to the first operating position of the manually operated member;

a first lever for opening and closing the gas supply opening in interlocked operation with operation of the external opening valve; and a latch lever that engages with the external opening valve when the valve is in an open state and maintains the engagement to maintain the external opening valve in the open state as long as a diver is holding the lever in the diver's mouth.

With the mouthpiece unit thus constituted, when the diver is holding the mouthpiece in his or her mouth, the latch lever will project between the diver's teeth or gums. With this being the state and since the operation of the external opening valve is linked to the manually operated member, shifting the manually operated member to the first operating position will cause the external opening valve to open, thereby opening the external opening. Also, the operation of the external opening valve is linked to the operation of the first lever for opening and closing the gas supply opening, so opening of the external opening valve is accompanied by the opening of the first lever, thereby initiating the supply of fresh breathing gas at a constant flow rate. The fresh breathing gas continues to be supplied at a constant flow rate as long as the latch lever continues to be held in the diver's mouth.

If the diver should accidentally allow the mouthpiece to come out of his or her mouth, the latch lever engagement would be broken and the external opening valve would therefore close. Thus, the result is the automatic prevention of the entry of water into the inhaled/exhaled air circulation chamber via the mouthpiece and external opening.

In a further configuration of the mouthpiece unit according to the present invention, the manually operated member can be moved against the resilient force from the first to a second operating position.

A mouthpiece unit for a semiclosed-circuit breathing apparatus, according to this further configuration, comprises:

a purge gas supply opening for introducing gas from the breathing gas cylinder to the inhaled/exhaled air circulation chamber at a flow rate that is higher than the constant flow rate at which breathing gas is supplied;

an opening for purging water, said opening being provided with a check valve that communicates the inhaled/exhaled air circulation chamber with the exterior;

a valve for opening the opening for purging water in interlocked operation with a shift to a second operating position of the manually operated member;

a second lever for opening the purge gas supply opening in interlocked operation with the shift to the second operating position of the manually operated member; and an exhalation air hose valve for closing the opening in communication with the exhalation air hose in interlocked operation with the shift to the second operating position of the manually operated member.

In the mouthpiece unit thus configured, water that has collected in the mouthpiece unit can be discharged by moving the manually operated member to the second operating position. Since operation of the valve for opening the opening for purging water is interlocked with the second lever and the exhalation air hose valve, this moving of the manually operated member opens the water purging opening and the purge gas supply opening to initiate the supply of gas at a high flow rate, and closes the inhalation air hose opening. This causes a sharp rise in the pressure inside the inhaled/exhaled air circulation chamber, resulting in any water that has collected being discharged together with the gas.

When needed, a large amount of breathing air can be provided by moving the manually operated member to the second operating position.

BEST MODE FOR CARRYING OUT THE INVENTION

An example of a semiclosed-circuit breathing apparatus that uses the mouthpiece unit of the present invention will now be described, with reference to the drawings.

(Overall Structure)

Figure 1:
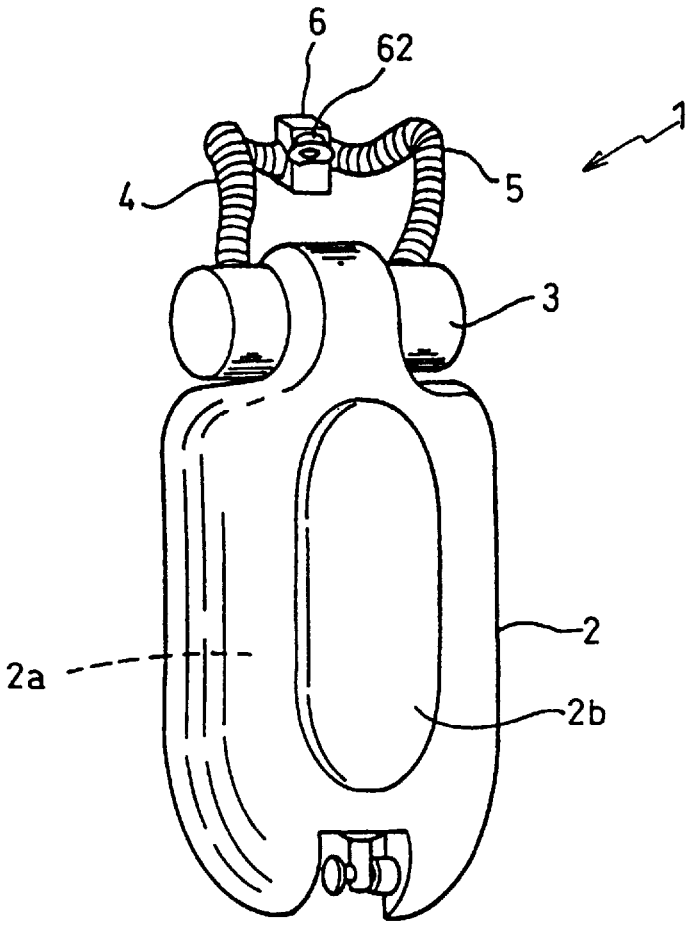
FIG. 1 is an external perspective view of an embodiment of a semiclosed-circuit breathing apparatus that is an embodiment of the present invention.
Figure 2:
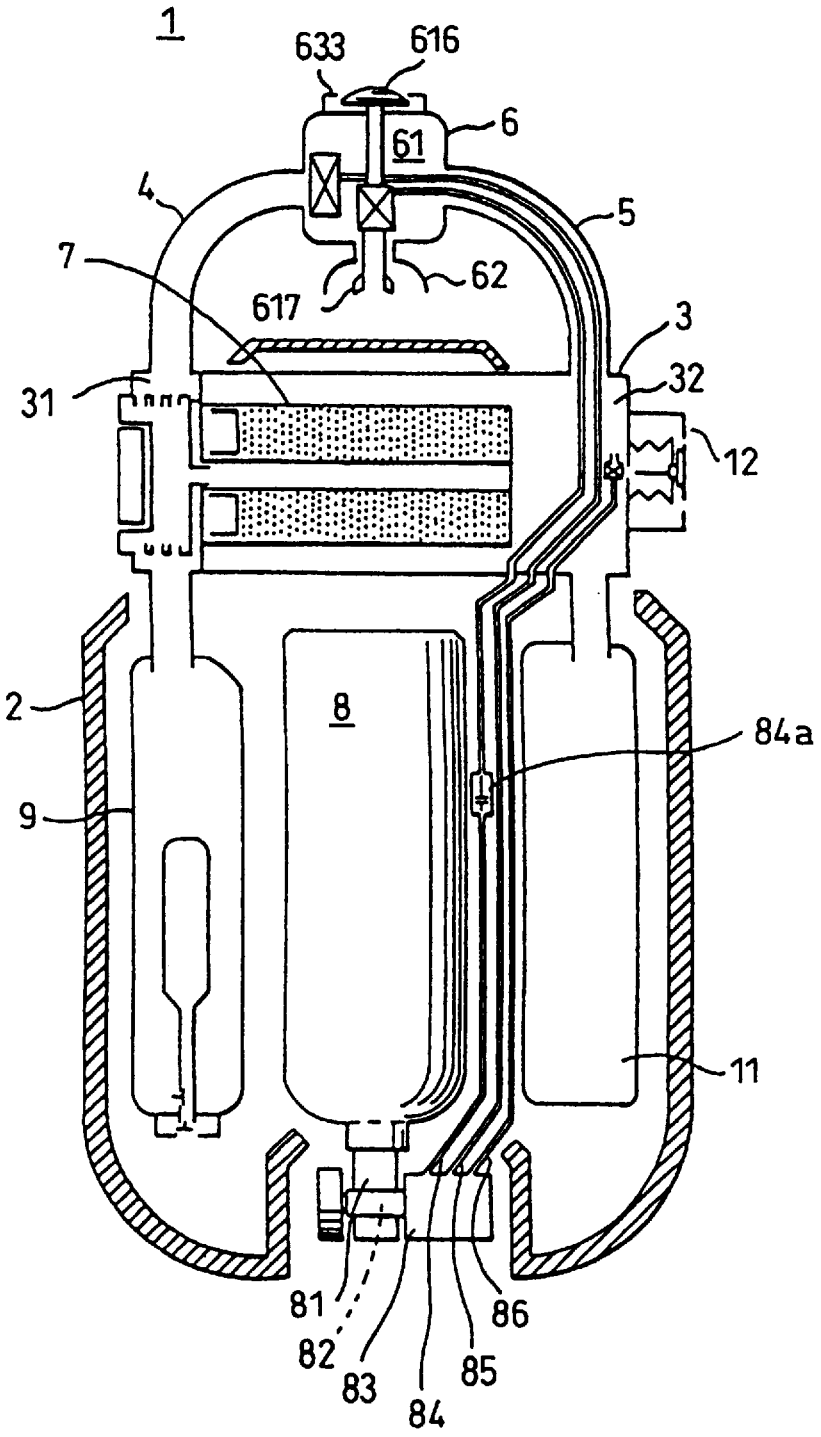
FIG. 2 is a schematic structural view showing the overall configuration of the semiclosed-circuit breathing apparatus.

FIGS. 1 and 2 show the overall structure of a semiclosed-circuit breathing apparatus according to an embodiment of the invention. As shown in FIG. 1, the semiclosed-circuit breathing apparatus 1 of this example is equipped with a hollow housing 2 which contains the component parts of the apparatus described below. One side of the housing 2 forms a back-resting surface 2*a* which rests against the back of the diver. Formed in the center of the opposing surface is an opening used for replacing the breathing gas cylinders. The opening has a removable cover 2*b*. Attached to the top edge of the housing 2 is a canister 3 with a built-in horizontal carbon dioxide adsorption apparatus. The canister is basically cylindrical in shape. A flexible exhalation air hose 4 is connected to the peripheral surface on one side of the canister 3, and a flexible inhalation air hose 5 to the peripheral surface on the other side. The ends of the exhalation air hose 4 and the inhalation air hose 5 are connected to a mouthpiece unit 6.

The main component parts of the apparatus 1 and their connections will now be described with reference to FIG. 2. As shown, an inhaled/exhaled air circulation chamber 61 is provided in the mouthpiece unit 6 in communication with the exhalation air hose 4 and inhalation air hose 5. As described above, the other ends of the exhalation air hose 4 and inhalation air hose 5 are connected to either side of the cylindrical canister 3 that has a built-in carbon dioxide adsorption apparatus 7. More specifically, the carbon dioxide adsorption apparatus 7 has an annular cross-section and is incorporated in a center portion of the canister 3, with an exhalation air passage 31 formed on one side and an inhalation air passage 32 formed on the other side. A breathing gas cylinder 8 is arranged vertically in the center of the housing 2, below the canister 3 and between an exhalation air bag 9 and an inhalation air bag 11. The exhalation air bag 9 communicates with the exhalation air passage 31 of the canister 3 and the inhalation air bag 11 communicates with the inhalation air passage 32 of the canister 3.

The breathing gas cylinder 8 is arranged with its gas discharge outlet 81 positioned at the bottom. The gas discharge outlet 81 is connected via an on/off valve 82 (not shown) to a regulator 83. The regulator 83 is used to reduce the gas pressure to around 8 to 9 kg/cm$^2$. The regulator 83 is connected by supply lines (not shown) to the BC jacket and the like, and on the high-pressure side has a remaining-pressure gage line connector (not shown). One of the lines connected to the regulator 83 is a gas supply line 84, which extends to the middle of the mouthpiece via the inhalation air passage 32 of canister 3 and the inhalation air hose 5. A flow rate adjustment orifice 84*a* interposed at an intermediate position is used to adjust the flow rate to 4 to 5 liters/minute for delivery to the mouthpiece. Another line that runs to the mouthpiece unit 6 is gas supply line 85, which is used to supply gas to purge water from the interior of the mouthpiece unit 6. The remaining line, gas supply line 86, is used to supply air during emergencies. The end of the supply line 86 is located within the inhalation air passage 32. The inhalation end of the canister 3 has an auto-valve mechanism 12 which controls the opening and closing of the gas supply line 86 and the automatic release of excess gas.

The overall gas flow arrangement will now be described. Exhaled air from the mouthpiece 62 of the mouthpiece unit 6 passes into the exhalation air bag 9 via the exhalation air hose 4 and exhalation air passage 31. During inhalation, the accumulated exhaled air is passed through the carbon dioxide adsorption apparatus 7 to remove the carbon dioxide and purify the air, which then flows through the inhalation air passage 32, collects in the inhalation air bag 11 and is also supplied to the mouthpiece unit 6 via the inhalation air hose 5 for inhalation. Inside the mouthpiece unit 6, a constant flow of fresh inhalation gas is maintained from the cylinder 8 via the gas supply line 84, resulting in the supply of a mixture of gases for inhalation.

(Mouthpiece Unit)

Figure 3:
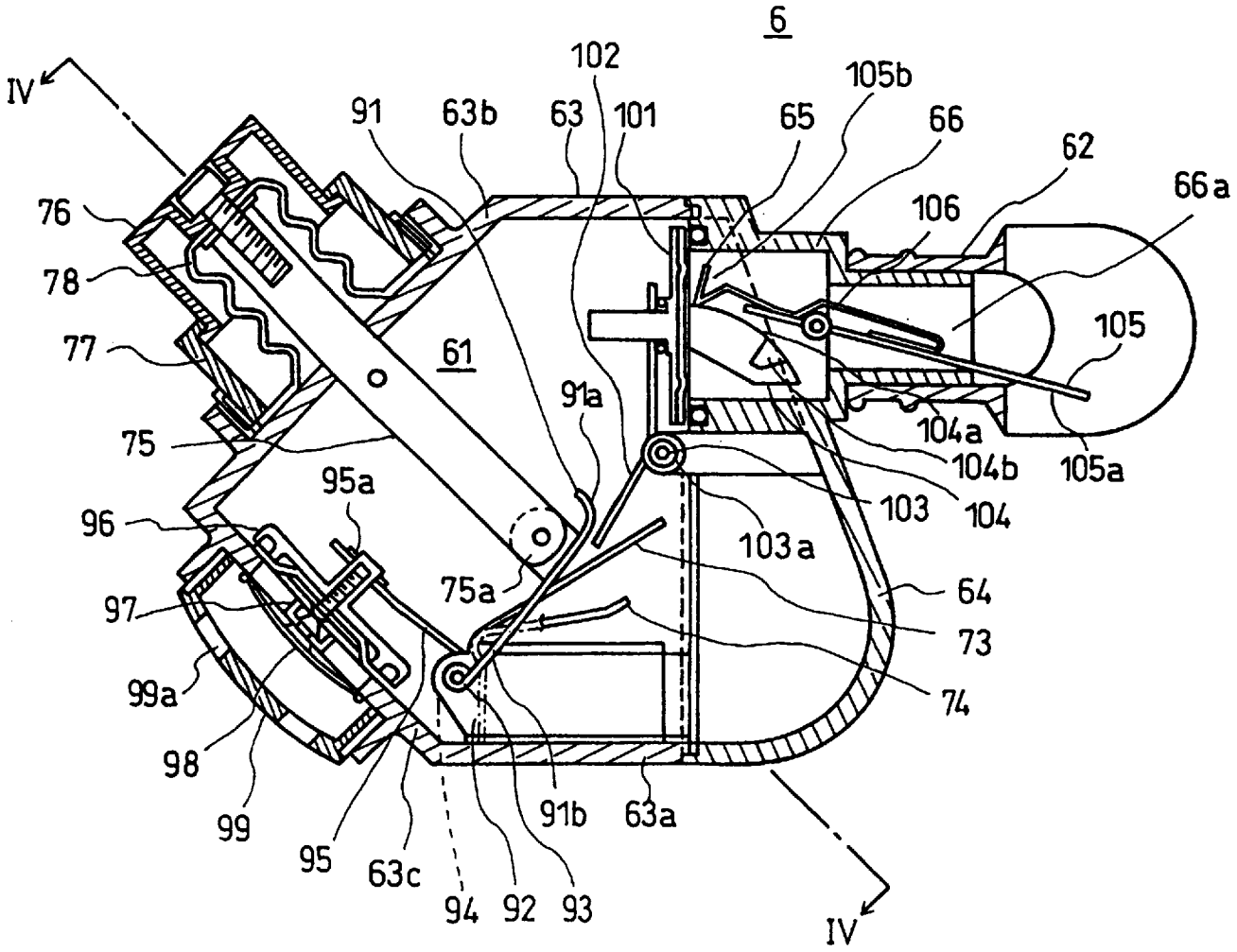
FIG. 3 is a schematic longitudinal cross-sectional view of the mouthpiece unit of the semiclosed-circuit breathing apparatus.
Figure 4:
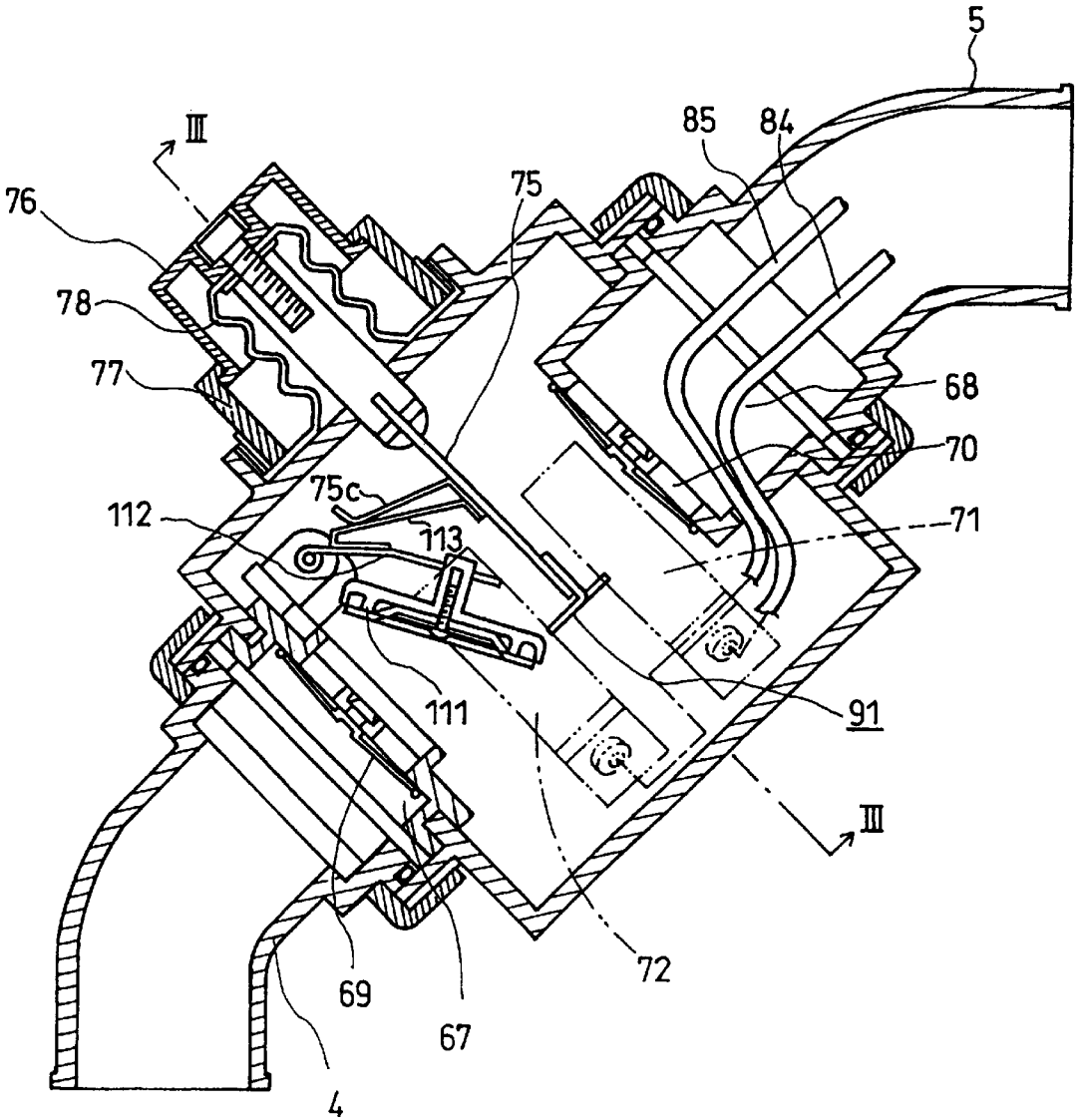
FIG. 4 is a schematic cross-sectional view along line IV—IV of FIG. 3.
Figure 5:
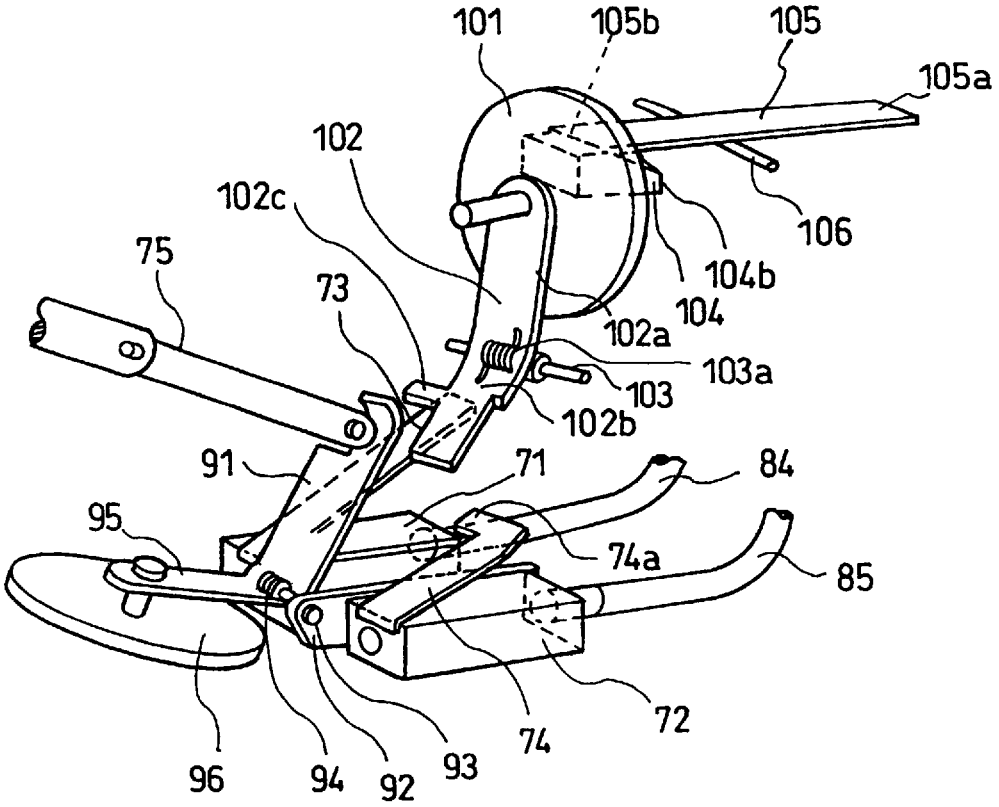
FIG. 5 is a schematic structural view of the principal parts of the mouthpiece unit of FIG. 3.

The mouthpiece unit of this example is illustrated in FIGS. 3, 4 and 5. The mouthpiece unit 6 has a main case 63 and a back case 64 within which the inhaled/exhaled air circulation chamber 61 is defined. The upper side of the back case 64 is an opening 65 to the outside. A mouthpiece attachment tube 66 projects horizontally rearward from this opening 65. The mouthpiece 62 is affixed to the periphery at the end of the attachment tube 66. An exhalation opening 67 is formed in one side of the case 63 and an inhalation opening 68 in the other side. The exhalation air hose 4 is connected to the exhalation opening 67 via a check valve 69 that only permits passage of fluid toward the exhalation air hose 4. Similarly, the inhalation air hose 5 is connected to the inhalation opening 68 via a check valve 70 that only permits passage of fluid away from the inhalation air hose 5. The two gas supply lines 84 and 85 run through the inhalation opening 68 and on into the breath circulation chamber 61 in the mouthpiece unit 6.

In the inhaled/exhaled air circulation chamber 61, the bottom wall 63*a* of the case 63 is provided with an inhalation gas supply opening 71 and a water-purging gas supply opening 72, arranged in parallel at a constant longitudinal spacing. The gas supply line 84 is attached to the rear end of opening 71 and the gas supply line 85 is attached to the rear end of opening 72. The front ends of the openings 71 and 72 are provided with first and second levers 73 and 74, respectively, for opening and closing the openings 71 and 72. Pushing the levers 73 and 74 down opens the openings 73 and 74, allowing inhalation gas to be supplied to the inhaled/exhaled air circulation chamber 61.

The front surface of the case 63 is defined by an upper sloping wall 63*b* and a lower sloping wall 63*c*. An actuating rod 75 that passes through the upper sloping wall 63*b* is arranged so that it can move reciprocally in the direction of its axis. A start button 76 is affixed at the tip of the actuating rod 75 and coaxially therewith. The start button 76 can move together with the actuating rod 75 along a guide cylinder 77 attached to the outer surface of the upper sloping wall 63*b*. A cylindrical diaphragm 78 around the actuating rod 75 is used to preserve a hydraulic seal where the rod 75 passes through the upper sloping wall 63*b*. Inside the inhaled/exhaled air circulation chamber 61, the lower end 75*a* of the rod 75 is connected to the end 91*a* of an operating lever 91 that extends horizontally and is able to rotate about its horizontal axis. The lower end 91*b* of the lever 91 is pivotally supported by a horizontal pivot pin 93 mounted in a bracket 92 that supports openings 71 and 72. A spring 94 mounted on the pivot pin 93 exerts a constant force that urges the lever 91 toward the rod 75.

The lower end of a first interlocking lever 95 extending downward toward the lower sloping wall 63*c* is rotatably attached to the pivot pin 93. This interlocking lever 95 is arranged so that when the operating lever 91 is pushed beyond a first operating position, described below, the lever 95 rotates as an integral unit with the lever 91. The end 95*a* of the lever 95 supports a water purge opening valve 96. A purge opening 97 is formed in a portion of the lower sloping wall 63*c* facing the valve 96, and is provided with a check valve 98 that only allows a fluid to flow to the outside. The outside of the opening 97 has a cap 99 perforated with numerous through-holes 99*a*.

The outside opening 65 in the back case 64 can be opened and closed by a valve 101. This valve 101 is supported on the upper edge of a second interlocking lever 102 at a rear surface facing the inhaled/exhaled air circulation chamber 61. The second interlocking lever 102 has an upper half 102*a* that extends vertically upwards and a lower half 102*b* that extends to the front from the lower end of the upper half 102*a* with a slight curvature. The lever 102 is pivotally supported by a pivot pin 103 that extends horizontally to the left and right at the curvature position 102*c*. The force of a return spring 103*a* on the pivot pin 103 keeps the valve 101 at the upper end pressed against the outside opening 65.

Attached to the surface of the valve 101 on the mouthpiece 62 side is an engaging member 104 having a curved surface 104*a* that curves back perpendicularly from the said valve 101 surface. This curved surface 104*a* has an engaging groove 104*b*. Disposed above the engaging member 104 is a latch lever 105 that extends back into the attachment tube 66, exposing the rear end 105*a* from the mouthpiece 62. This latch lever 105 is pivotally mounted by means of a pivot pin 106 that extends horizontally to each side from an intermediate position. The latch lever 105 has an engaging edge 105*b* for engaging with the groove 104*b*.

The pivot pin 106 of the latch lever 105 is positioned at a point along the center line 66*a* of the attachment tube 66. The curved surface 104*a* of the engaging member 104 extends from above to below the center line 66*a*, with the engaging groove 104*b* being formed on the lower side of the center line. Consequently, as shown in FIG. 3, the engaging edge 105*b* of the latch lever 105 normally rests on top of the curved surface 104*a*, and the other end 105*a* is in contact with the lower edge of the mouthpiece 62.

As shown in FIG. 4, an engaging lever 75*c* extends transversely from the exhalation opening 67 side of the actuating rod 75. This engaging bar 75*c* abuts a third interlocking lever 113 affixed to a lever 112 that supports an exhalation air hose valve 111 that is able to close the exhalation opening 67. Pushing in actuating rod 75 causes the third interlocking lever 113 to be pushed by engaging lever 75*c*, resulting in an integral movement by the support lever 112 that moves the exhalation air hose valve 111, thereby making it possible to close the exhalation opening 67.

The operation of the mouthpiece unit 6 will now be explained with reference to FIGS. 3 to 7.

(Inhalation Gas Supply Operation)

Figure 6:
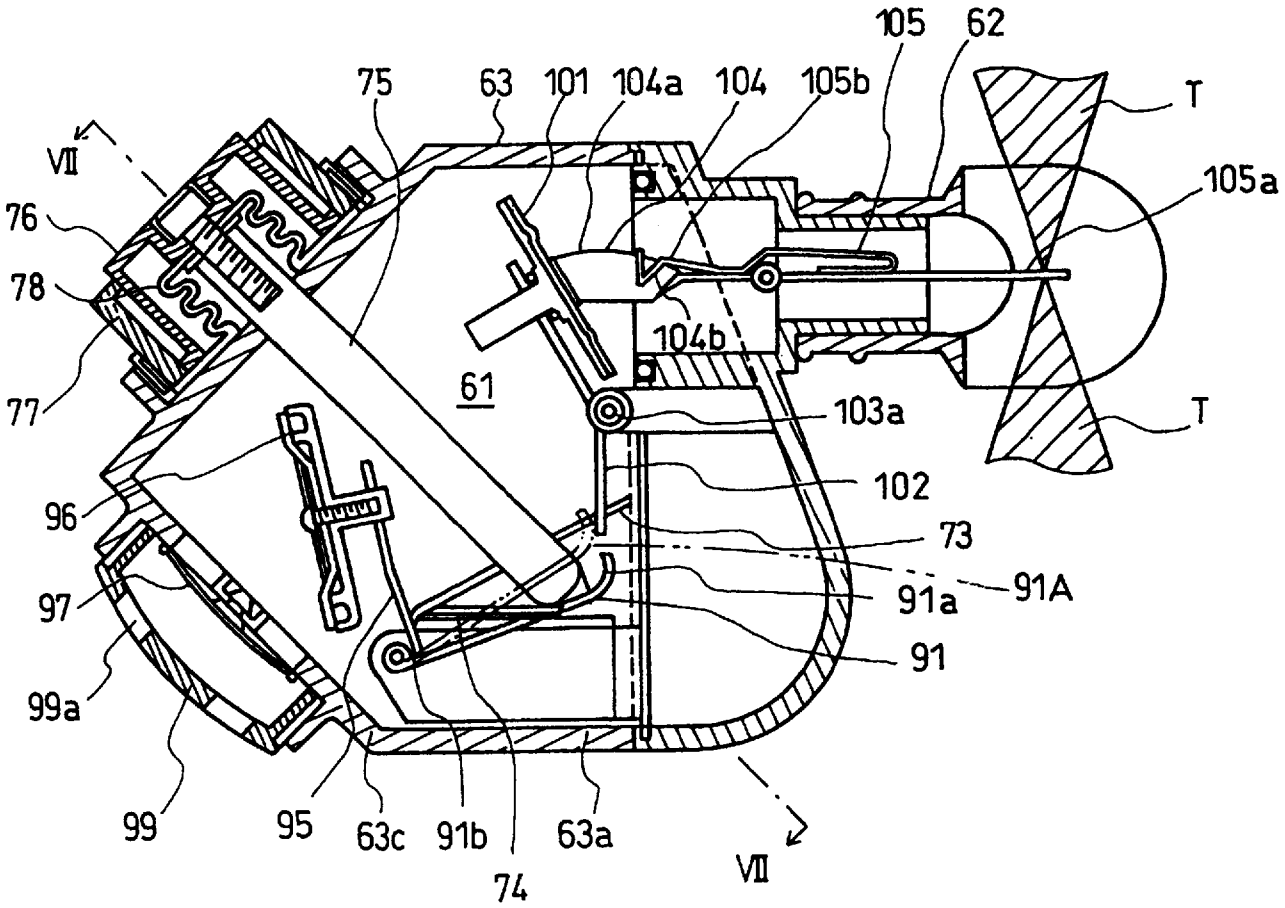
FIG. 6 is a view for illustrating the supplying of inhalation gas to and the purging of water from the mouthpiece unit of FIG. 3.

First, the inhalation gas supply operation will be described. When the diver holds the mouthpiece 62 in his or her mouth, the exposed rear end 105*a* of the latch lever 105 moves from an inclined to a horizontal state that follows the center line 66*a*. Namely, as shown by FIG. 6, this is because the rear end 105*a* of the latch lever 105 is gripped between the diver's upper and lower teeth T or gums. As a result, the engaging end 105*b* of the latch lever 105 is pressed onto the curved surface 104*a* of the engaging member 104 on the surface of the valve 101 by the resilience of the latch lever.

In this state, the start button 76 is operated to push the actuating rod 75 to turn the end 91*a* of the operating lever 91 linked to the end of the rod 75 to the position 91A (first operating position) indicated in FIG. 6 by a phantom line. The operating lever end 91*a* abuts against the lower half 102*b* of the second interlocking lever 102, rotating the second interlocking lever 102 about the pivot pin 103. As shown in FIG. 5, the lower half 102*b* of the lever 102 has an engaging projection 102*c* extending to the side, arranged so that the curved path followed by the engaging projection 102*c* intersects the position of the front edge of the first opening/closing lever 73 located below. Thus, the pivotal motion of the second interlocking lever 102 pushes down the lever 73, which opens the inhalation gas supply opening 71 to thereby initiate delivery of breathing gas from the gas supply line 84 to the inhaled/exhaled air circulation chamber 61, via the gas supply opening 71. Moving the lever 73 thus opens the valve 101 supported by the upper half 102*a* of the second interlocking lever 102. This opening of the valve 101 moves the engaging member 104 on the valve surface forward, moving the engaging end 105*b* of the latch lever 105 on the curved surface 104*a* of the engaging member 104 into engagement with the engaging groove 104*b*.

This pushes in the lever 73, whereby the supply of breathing inhalation gas is started, and the external opening valve 101 is opened and maintained by the latch lever 105. The position to which the actuating rod 75 has to be inserted to form this state is the first starting position that is reached when the start button 76 on the tip of the rod is pressed. When the start button 76 is released after this state has been achieved, the start button 76, actuating rod 75 and operating lever 91 are retracted to their original positions under the force of the spring 94. However, since the inhalation air supply state is maintained by the latch lever, the diver is able to continue to breathe.

(Water Purging Operation)

Water in the mouthpiece unit can be purged by pressing the start button 76 down as far as it can go, beyond the first operating position. The configuration is arranged so that while the track of the end 91*a* of the operating lever 91 connected to the end of the actuating rod 75 intersects the path of movement of the lower end of the lower half 102*b* of the second interlocking lever 102 up to the first operating position, intersection does not take place beyond that position. Therefore under the pressure of the actuating rod 75 the operating lever 91 is rotated until it reaches the position of the second opening/closing lever 74 that is located at a lower position than the first opening/closing lever 73. The end 91*a* of the operating lever 91 abuts against an engaging projection 74*a* that extends sideways from the end of the second opening/closing lever 74, pressing down the lever 74. Pressing down the lever 74 opens the water-purging gas supply opening 72, allowing gas to be supplied at high pressure to the inhaled/exhaled air circulation chamber 61.

Figure 7:
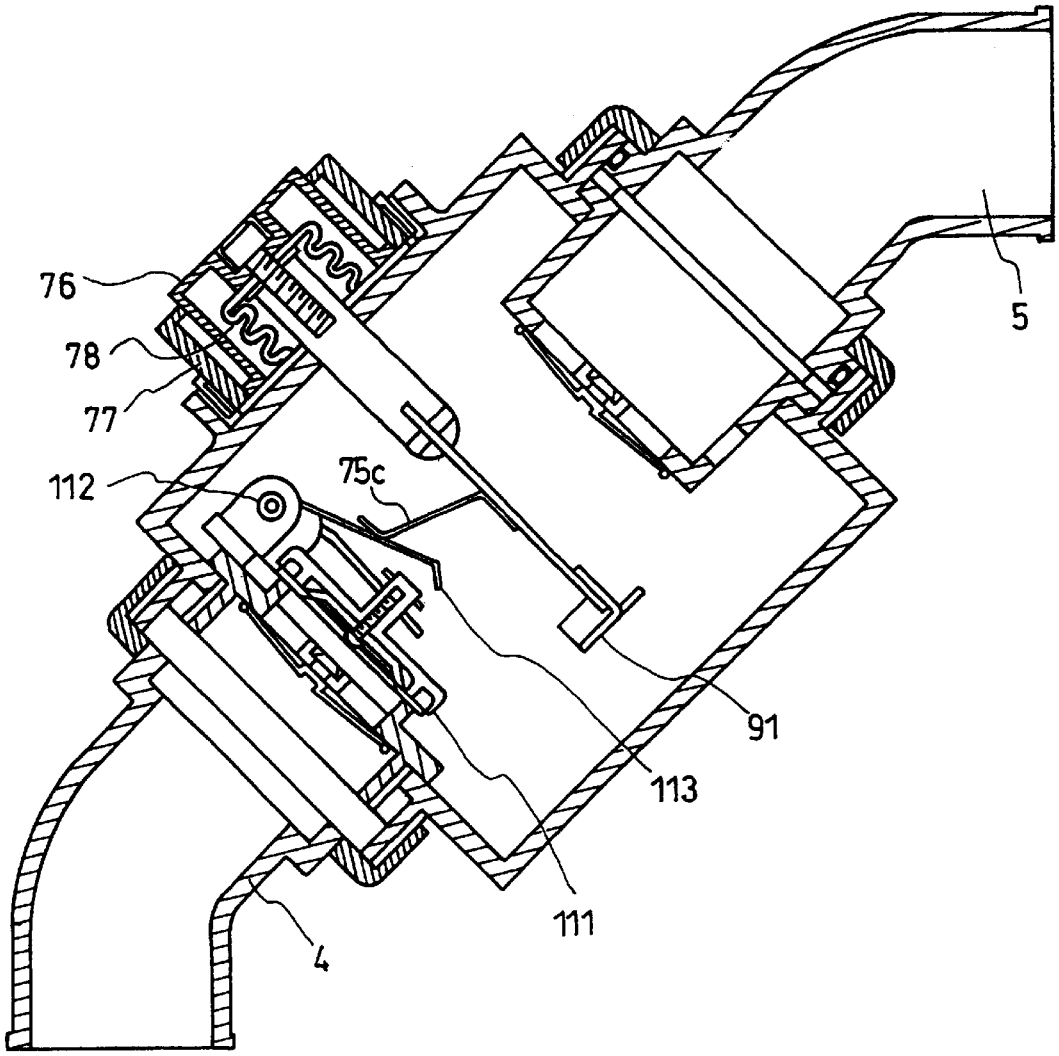
FIG. 7 is a schematic cross-sectional view along line VII—VII of FIG. 6.

When at the same ti me the actuating rod 75 is pressed in beyond the first operating position, the first interlocking lever 95 starts to move integrally with the movement of the operating ever 91, until at the second operating position the water-purging opening is fully open. This state is shown in FIG. 6. As shown in FIG. 7, when the actuating rod 75 is inserted more deeply, beyond the first operating position, the pressure of the engaging lever 75*c* causes the exhalation opening 67 to be sealed completely shut by the exhalation air hose valve 111.

The position which is the limit to which the start button 76 can be inserted is the second operating position. In this state, a high-pressure flow of gas from the gas supply line 85 is supplied to the inhaled/exhaled air circulation chamber 61. As described above, at this point the exhalation opening 67 is closed, while the inhalation opening 68 is also closed, by the check valve 70. This causes a sharp rise in pressure within the inhaled/exhaled air circulation chamber 61. As a result, water in the chamber 61 is discharged through the check valve 97 and out of the purge outlet, carried by the gas. When the start button 76 is released, each component is urged back to its original position by spring force. Even then, the open state of the opening 65 is maintained by the action of the latch lever 105, and inhalation gas continues to be supplied through the inhalation gas supply opening 71. It goes without saying that when there is a temporary need for more inhalation gas, the extra gas can be supplied by pressing the start button fully in.

(Operation of Shutting Off the Supply of Inhalation Gas)

If the mouthpiece 62 becomes dislodged from the diver's mouth when the diver is submerged, for example, the latch lever 105 again becomes free to pivot about the pivot pin 106. Consequently, the engaging end 105*b* of the latch lever 105 disengages from the groove 104*b* of the engaging member 104. As a result, the second operating lever 102 that supports the external opening valve 101 is urged back to its original position by the force of the spring 103*a* on the pivot pin 103, thereby closing the external opening 65 and the gas supply opening 71.

Thus, if the mouthpiece 62 becomes dislodged the external opening 65 closes automatically, preventing the entry of water into the apparatus. In addition, the supply of breathing gas is also shut off automatically, reducing gas wastage.

Industrial Applicability

In the semiclosed-circuit breathing apparatus of the present invention, the supply of breathing gas can be initiated and a water purge operation effected simply by operating the start button (manually operated member). Operation is therefore very easy. Moreover, if the mouthpiece becomes dislodged from the diver's mouth, the latch lever moves, automatically closing the external opening and shutting off the supply of breathing gas. Entry of water can therefore be prevented. In addition, since the supply of breathing gas stops automatically if the mouthpiece becomes dislodged from the mouth, breathing gas is not wasted.

What is claimed is:

1. A mouthpiece unit for a semiclosed-circuit breathing apparatus constituted so that exhaled air recovered from the mouthpiece unit is regenerated by being passed through a carbon dioxide adsorption apparatus, and a mixture of the regenerated gas and a constant flow of fresh gas for inhalation supplied from a breathing gas cylinder is supplied to the mouthpiece unit as inhalation gas and surplus gas is discharged to the outside, comprising:

an inhaled/exhaled air circulation chamber that includes an opening in communication with an exhalation air hose for circulation of exhaled air, an opening in communication with an inhalation air hose for circulation of inhaled air, and an external opening in communication with an exterior;

a gas supply opening for supplying the inhaled/exhaled air circulation chamber with a constant flow of fresh breathing gas from the breathing gas cylinder;

a mouthpiece attached to the external opening;

a manually operated member that is maintained at an initial position by resilient force and can be shifted to a first operating position against the resilient force;

an external opening valve for opening the external opening in interlocked operation with the shift to the first operating position of the manually operated member;

a first lever for opening and closing the gas supply opening in interlocked operation with operation of the external opening valve; and a latch lever that engages with the external opening valve when the valve is in an open state and maintains the engagement to maintain the external opening valve in the open state as long as a diver is holding the lever in the diver's mouth.

2. A mouthpiece unit for a semiclosed-circuit breathing apparatus according to claim 1, wherein the manually operated member can be shifted from the first operating position to a second operating position against the resilient force, further comprising:

a purge gas supply opening for introducing gas from the breathing gas cylinder to the inhaled/exhaled air circulation chamber at a flow rate that is higher than the constant flow rate at which breathing gas is supplied;

an opening for purging water, said opening being provided with a check valve that communicates the inhaled/exhaled air circulation chamber with the exterior;

a valve for opening the opening for purging water in interlocked operation with a shift to a second operating position of the manually operated member;

a second lever for opening the purge gas supply opening in interlocked operation with the shift to the second operating position of the manually operated member; and an exhalation air hose valve for closing the opening in communication with the exhalation air hose in interlocked operation with the shift to the second operating position of the manually operated member.

* * * * *